US008074411B1

(12) United States Patent
Anderson et al.

(10) Patent No.: US 8,074,411 B1
(45) Date of Patent: Dec. 13, 2011

(54) FABRIC WALL PANEL AND TRACK

(76) Inventors: Andrew Jacob Anderson, Newnan, GA (US); Andy W. Anderson, Sr., Villa Rica, GA (US)

( * ) Notice: Subject to any disclaimer, the term of this patent is extended or adjusted under 35 U.S.C. 154(b) by 120 days.

(21) Appl. No.: 12/558,004

(22) Filed: Sep. 11, 2009

(51) Int. Cl.
*E04B 1/00* (2006.01)

(52) U.S. Cl. ..... 52/222; 52/273

(58) Field of Classification Search ..... 52/222, 52/63, 273; 24/530, 531, 568, 570, 538, 24/542, 543, 544, 545; 160/327, 328, 329, 160/369, 378, 380, 381
See application file for complete search history.

(56) References Cited

U.S. PATENT DOCUMENTS

| | | | | |
|---|---|---|---|---|
| 1,171,952 | A | 2/1916 | Higgin | |
| 1,201,338 | A | 10/1916 | Orr | |
| 1,588,161 | A | 6/1926 | Bost | |
| 2,112,631 | A | 3/1938 | MacDonald | |
| 2,526,912 | A | 10/1950 | Swanson | |
| 3,273,633 | A | 9/1966 | Seidmon et al. | |
| 3,379,237 | A | 4/1968 | Miller | |
| 3,380,210 | A | 4/1968 | Neal et al. | |
| 3,477,574 | A | 11/1969 | Malfroy | |
| 3,489,085 | A | 1/1970 | Kirkpatrick | |
| 3,552,476 | A | 1/1971 | Le Tarte | |
| 3,667,177 | A | 6/1972 | Biela | |
| 3,706,171 | A | 12/1972 | Shayman | |
| 3,757,479 | A | 9/1973 | Martinez | |
| 3,783,931 | A | 1/1974 | Assael | |
| 3,830,027 | A | 8/1974 | Paisley et al. | |
| 3,833,046 | A | 9/1974 | Tombu | |
| 3,871,153 | A | 3/1975 | Birum, Jr. | |
| 3,928,627 | A | 12/1975 | Mand et al. | |
| 3,928,897 | A | 12/1975 | Tombu | |
| 3,948,347 | A | 4/1976 | Rutledge | |
| 3,963,094 | A | 6/1976 | Nowikas | |
| 3,971,867 | A | 7/1976 | Randall | |
| 4,018,260 | A | 4/1977 | Baslow | |
| 4,107,887 | A | 8/1978 | Wendt | |
| 4,146,999 | A | 4/1979 | Petrovec et al. | |
| 4,197,923 | A | 4/1980 | Harris et al. | |
| 4,250,676 | A | 2/1981 | Presby | |
| 4,252,365 | A | 2/1981 | Ferguson | |
| 4,283,891 | A | 8/1981 | Moeller | |
| 4,459,790 | A | 7/1984 | Vermillion | |
| 4,479,339 | A | 10/1984 | Kroh | |
| 4,527,370 | A | 7/1985 | Schuette | |
| 4,548,010 | A | 10/1985 | Hintsa | |
| 4,676,016 | A | 6/1987 | Phillips et al. | |
| 4,731,972 | A | 3/1988 | Anderson | |
| 4,765,039 | A * | 8/1988 | Rowlands et al. | 24/556 |
| 4,788,806 | A | 12/1988 | Sease | |

(Continued)

*Primary Examiner* — Eileen D Lillis
*Assistant Examiner* — Jessica Laux
(74) *Attorney, Agent, or Firm* — Smith Gambrell & Russell LLP

(57) ABSTRACT

A fabric wall panel includes a number of frame members for attachment to a wall to form a frame. Each frame member has a stationary jaw for attachment to the wall and a movable jaw pivotally attached to the stationary jaw by a flexible and stretchable hinge for rotation between an open position and a close position. Each frame member has an opening lock that locks the movable jaw in the open position to facilitate the insertion of fabric between the movable jaw and the stationary jaw. Each frame member also has one or more closing locks that connect the movable jaw to the stationary jaw to thereby hold the movable jaw in the closed position.

6 Claims, 5 Drawing Sheets

U.S. PATENT DOCUMENTS

| | | | | | |
|---|---|---|---|---|---|
| 4,805,330 | A | | 2/1989 | Bubernak | |
| 4,817,699 | A | * | 4/1989 | Fein | 160/327 |
| 4,825,931 | A | | 5/1989 | Fein | |
| 4,949,518 | A | | 8/1990 | Nagel et al. | |
| 5,009,043 | A | | 4/1991 | Kurrasch | |
| 5,029,422 | A | | 7/1991 | Scherrer | |
| 5,174,086 | A | | 12/1992 | Payne et al. | |
| 5,187,005 | A | | 2/1993 | Stahle et al. | |
| 5,214,891 | A | | 6/1993 | Edlin | |
| 5,214,892 | A | | 6/1993 | Livingston et al. | |
| 5,230,377 | A | * | 7/1993 | Berman | 160/327 |
| 5,535,556 | A | | 7/1996 | Hughes, Jr. | |
| 5,715,638 | A | | 2/1998 | Anderson, Sr. | |
| 5,769,562 | A | | 6/1998 | Jones | |
| 5,806,257 | A | | 9/1998 | Cornils et al. | |
| 5,836,113 | A | | 11/1998 | Bachman | |
| 5,921,044 | A | | 7/1999 | Holstrager | |
| 6,115,982 | A | | 9/2000 | Lindenberg | |
| 6,158,915 | A | | 12/2000 | Kise | |
| 6,164,364 | A | * | 12/2000 | Morris | 160/327 |
| 6,367,513 | B1 | | 4/2002 | Cain | |
| 6,431,251 | B1 | | 8/2002 | Yerusalim et al. | |
| 6,574,936 | B1 | | 6/2003 | Anderson, Sr. | |
| 6,622,452 | B2 | | 9/2003 | Alvaro | |
| 2006/0130412 | A1 | | 6/2006 | Von Arx et al. | |
| 2007/0283656 | A1 | * | 12/2007 | Anderson | 52/506.06 |

* cited by examiner

FABRIC WALL PANEL AND TRACK

FIELD OF THE INVENTION

This invention relates to a fabric wall panel for use in decorating, and more particularly, relates to a track for a frame for a fabric wall panel with an improved closure and clamping mechanism.

BACKGROUND OF THE INVENTION

Fabric wall panels are used to decorate the interior space in many buildings. Fabric coverings for the panels are available in numerous textures and patterns that can be coordinated with the furnishings and carpets in a room. These fabric wall panels can be customized to meet the decorating needs of various locations and decorating tastes.

Besides decorating versatility, fabric wall panels provide other desirable features. Such features include sound and heat insulation. Particularly, in large rooms such as auditoriums and theaters, fabric wall panels may include a layer of acoustical material hidden behind the fabrics that modifies the acoustical character of the room. In addition, heat-insulating material may be mounted behind the fabrics to enhance heat transfer properties of a wall.

A substantial cost involved in using fabric panels is the cost of installation. Moreover, if the fabric becomes worn or the decorating scheme changes, the need may arise to change the fabric panels. Consequently, the method of mounting and/or changing the fabric wall panels becomes an important consideration when fabric wall panels are selected for a building project.

Another consideration in the selection and use of fabric wall panels is assuring a quality installation. Particularly, the wall panels should line up uniformly with each other, and the seams between adjacent wall panels should be tight and uniform. With most fabric wall panel systems, quality of installation including alignment and uniformity of seams depends on the skill of the installer.

Some prior fabric wall panels are installed in situ. For example, as disclosed in Baslow U.S. Pat. No. 4,018,260, border pieces of a panel are permanently attached to the wall to form a framework for mounting a fabric sheet. The fabric sheet completely covers the wall without being adhered to the wall itself. The linear border pieces include a key way into which the fabric is forced by means of a compressible spline. The linear border pieces also include a storage channel, which allows the border pieces to create a finished look at the edges. The uniformity of installation depends on the skill of the installer in terms of aligning the framework and particularly forcing the fabric into the key way so that the fabric is uniformly stretched on the framework.

In addition, fabric wall panels can be prefabricated off of the wall. One method for installing a prefabricated fabric wall panel employs a cross-nailing system as disclosed by the patent to Anderson, U.S. Pat. No. 4,731,972. Each fabric wall panel disclosed in the Anderson patent is prefabricated and then installed by driving two headless pin nails at an angle in a crossed fashion through the frame pieces of the prefabricated wall panel. The crossed nails penetrate completely through the fabric, partially penetrate the frame, and securely fasten the fabric wall panel to the wall. A fabric wall panel attached using this cross-nailing method cannot be easily removed from the wall if one should desire to replace the fabric, replace the panel, or remove the panel entirely.

One successful removable wall panel system is disclosed in Anderson U.S. Pat. No. 5,715,638. In that patent, a fabric wall panel is mounted on the wall by means of hangers. Each frame member of each wall panel has a spine with an elongated slit, a side edge, and a front edge that together define a groove. A flat filler insert is fitted within the groove of each frame member. Fabric is stretched over the frame and flat filler insert and is bonded to the back of the spine of each frame member to complete the finished fabric wall panel. The hanger has a flat base and a perpendicularly extending tongue with an enlarged head. A number of hangers are affixed on the wall using an adhesive. The slit on the frame of the fabric wall panel is aligned with the tongue of hanger on the wall, and the prefabricated fabric wall panel is affixed to the wall by pressing the slit over the tongue on the hanger. Each fabric wall panel can be prefabricated in standard sizes or custom fabricated on site. Each fabric wall panel can also be independently replaced or removed entirely by unsnapping the fabric wall panel from the supporting hangers and replacing it with another prefabricated fabric wall panel.

Another successful removable wall panel system is disclosed in Anderson U.S. Pat. No. 6,574,936. That patent discloses a fabric wall panel comprising a frame constructed of frame members or tracks. Wall hangars are affixed to the walls. Each fabric wall panel is separately constructed. The frame members engage the wall hangers to allow easy attachment and removal of the prefabricated fabric wall panel from the walls.

Another removable wall panel system is disclosed in Anderson United States Patent Application Publication No. 2007/0283656. The fabric wall panels comprise a frame, a flat filler, and a fabric stretched over the flat filler and held by a clamp around the edges of the frame. The fabric wall panels are removably mounted on the wall by means of a hanger. Because of the fabric is held on the frame by the clamp, the fabric wall panel may be assembled either on the wall or separately from the wall.

U.S. Pat. Nos. 4,676,016; 4,805,330; and 6,431,251 all disclose a wall panel system in which the frame members are connected directly to the wall, and the frame members engage the fabric by a hook and snap arrangement.

The prior art has thus failed to disclose a fabric wall panel system in which the installer can easily mount and assemble the fabric wall panels in situ on the walls.

SUMMARY OF THE INVENTION

The present invention satisfies the above-described needs with a fabric wall panel having a frame over which a fabric is stretched and secured. In some embodiments, a flat filler insert is positioned between the wall and the fabric. The frame comprises a plurality of linear frame members or tracks attached to the wall. Each track has closure mechanism comprising a stationary jaw for attachment to the wall, a flexible and stretchable hinge, and a movable jaw that is connected to the stationary jaw by means of the flexible and stretchable hinge.

The track has an open position in which the movable jaw pivots away from the fixed jaw by means of the hinge to create an opening for the insertion of fabric into the opening between the open movable jaw and the stationary jaw. In addition, the track has an opening lock to hold the movable jaw in its open position during installation of the fabric. The opening lock consists of a movable lock member on the movable jaw and a matching stationary lock member on the stationary jaw that engage each other to hold the movable jaw in the open position. The flexible and stretchable hinge allows the movable lock member and the stationary lock member to engage and disengage when pressure is exerted on the movable jaw.

The track also has a close position in which the movable jaw pivots by means of the flexible and stretchable hinge into engagement with the stationary jaw to secure the fabric to the tracks that form the frame of the fabric wall panel. In order to maintain the movable jaw in the close position and clamp the fabric between the movable jaw and the stationary jaw, the track has a back closing lock and a front closing lock between the movable jaw and the stationary jaw for holding the movable jaw in the close position and engaging the fabric. In order to assure positive clamping of the fabric, the stationary jaw has a stationary front return and the movable jaw has a movable front return, each of which project toward each other, but do not meet, when the movable jaw is in the closed position. The space between the movable front return and the stationary front return provides an access opening for accommodating thick fabric along a line where two adjacent tracks abut each other. Further, the movable front return is offset from the front closing lock in order to ensure that pressure exerted by the tension in the fabric is carried by the movable front return and therefore does not tend to disengage the front closing lock.

When the fabric of the fabric wall panel needs replacing, the fabric can be replaced by opening the movable jaw and removing the fabric while the tracks of the fabric wall panel are still attached to the wall. New fabric is inserted into the opening between the movable jaw and the stationary jaw, and the movable jaw is then closed to stretch and clamp the new replacement fabric between the movable jaw and the stationary jaw of the tracks forming the frame.

In separate embodiments of the present invention, the movable front return of the movable jaw may have, for example, a straight profile or a beveled profile, depending on the desired aesthetic appearance of the interface between two adjacent, abutting fabric wall panels.

Further objects, features and advantages will become apparent upon consideration of the following detailed description of the invention when taken in conjunction with the drawings and the appended claims.

DETAILED DESCRIPTION OF THE PREFERRED EMBODIMENT

Figure 1:
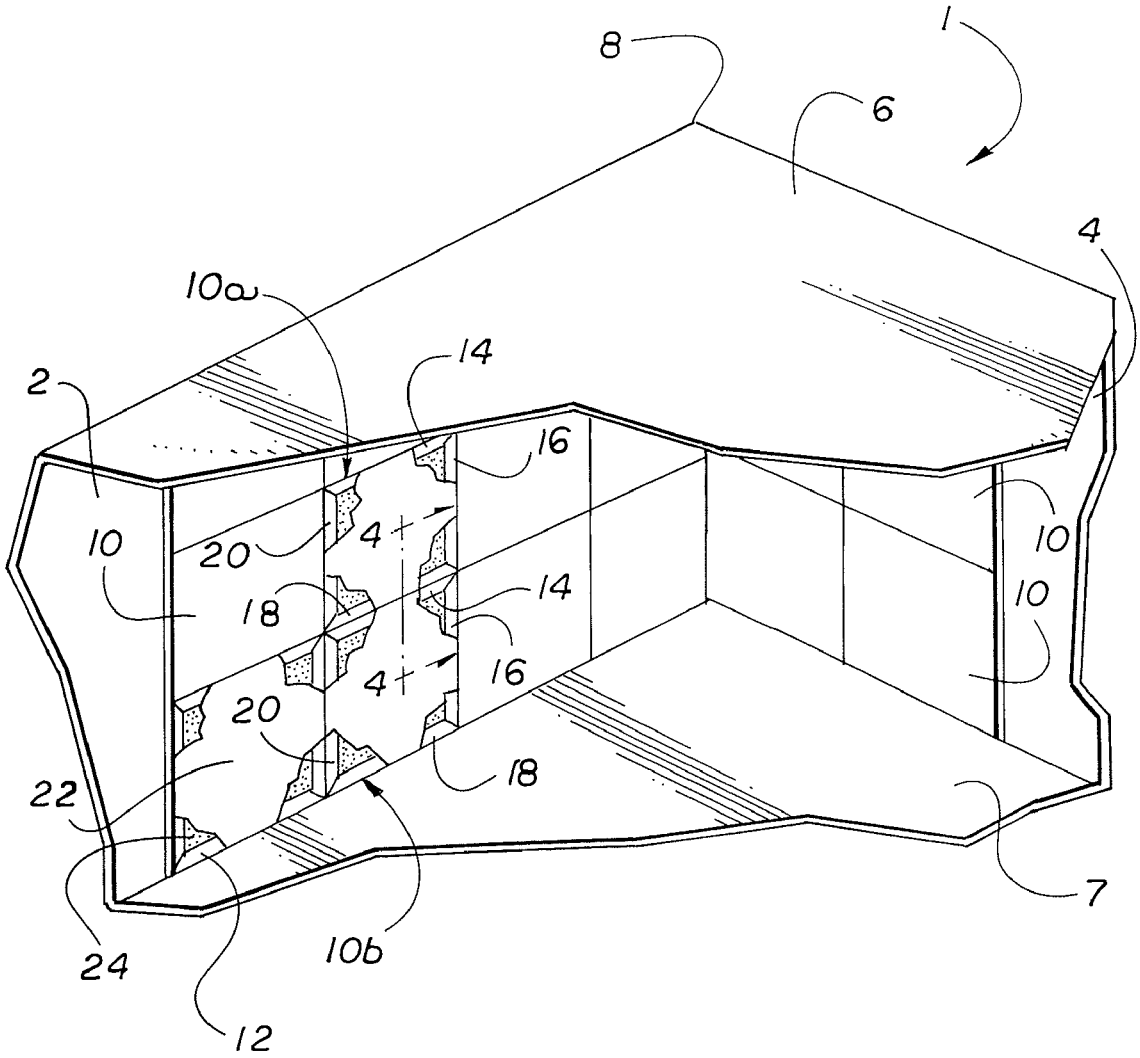
FIG. 1 is a perspective view of a room having walls covered with a plurality of fabric wall panels constructed in accordance with the present invention.

The present invention is a fabric wall panel system, with an improved linear frame member or track and a method for installing a fabric wall panel on a wall and replacing the fabric on the fabric wall panel. The fabric wall panel system comprises a plurality of fabric wall panels mounted on the wall of a room. For the purposes of the present invention, a wall includes existing or permanent walls, moveable walls, partitions, and the like. Although the present invention will be generally described in the context of a room with walls of sheet rock, those skilled in the art will recognize that the present invention is not limited to that environment. Referring now to the drawings, in which like numerals represent like elements throughout the several figures, the present invention will be described.

Turning to the figures, FIG. 1 is a perspective view of a room 1 with a back wall 2 and a side wall 4 covered with fabric wall panels 10, including fabric wall panels 10*a* and 10*b*, in accordance with the present invention. The room also has a ceiling 6 and a floor 7. The back wall 2 and the side wall 4 converge at a corner 8.

Each of the fabric wall panels 10 in FIG. 1 is similarly constructed. The fabric wall panel 10 comprises a rectangular frame 12, a fabric 22, and a flat filler insert 24. Each frame 12 is made up of four linear frame members or tracks 14, 16, 18, and 20. The tracks 14, 16, 18, and 20 are extrusions made of high impact premium unplasticized polyvinylcloride, such as PLC27766 sold by Georgia Gulf Corporation of Atlanta, Ga. and of a melt processable rubber, such as Alcryn®4070 NC sold by Ferro Corporation of Cleveland, Ohio.

Figure 2:
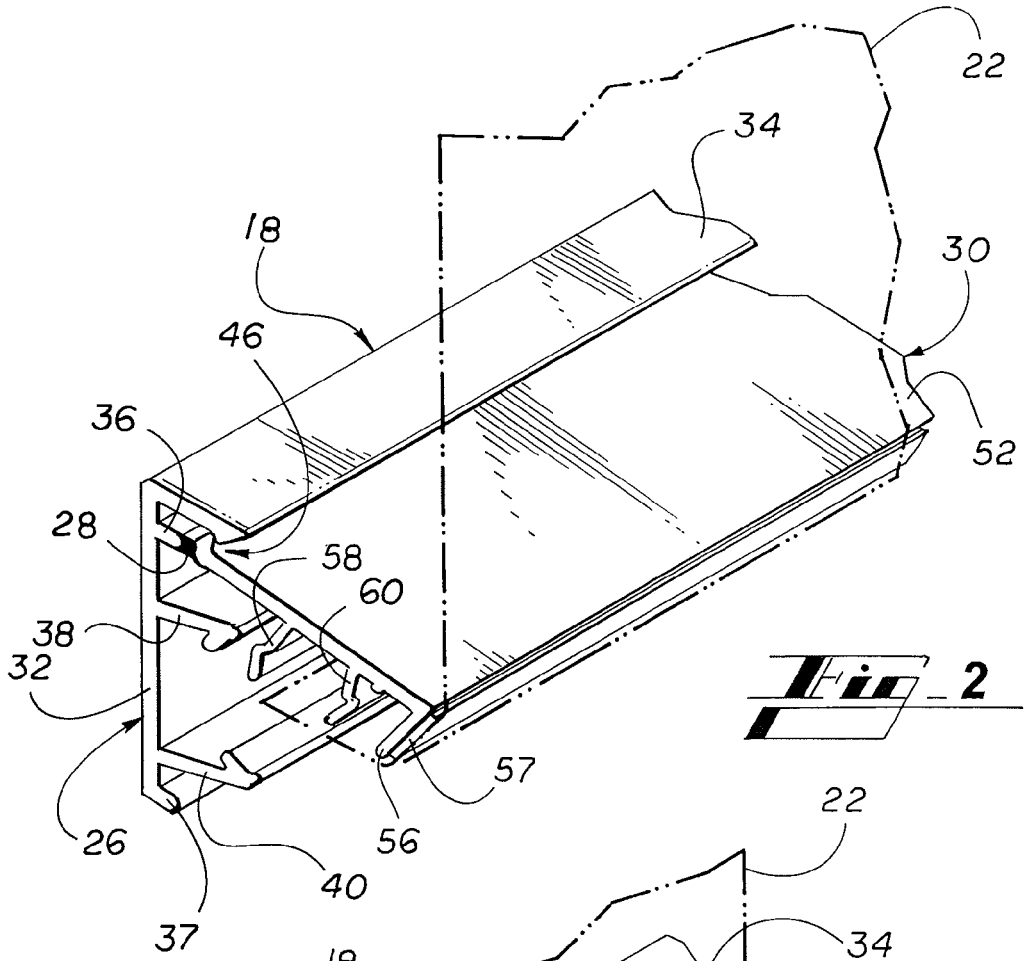
FIG. 2 is a perspective view of a frame member or track for the fabric wall panel in an open position in accordance with a first embodiment of the present invention.
Figure 3:
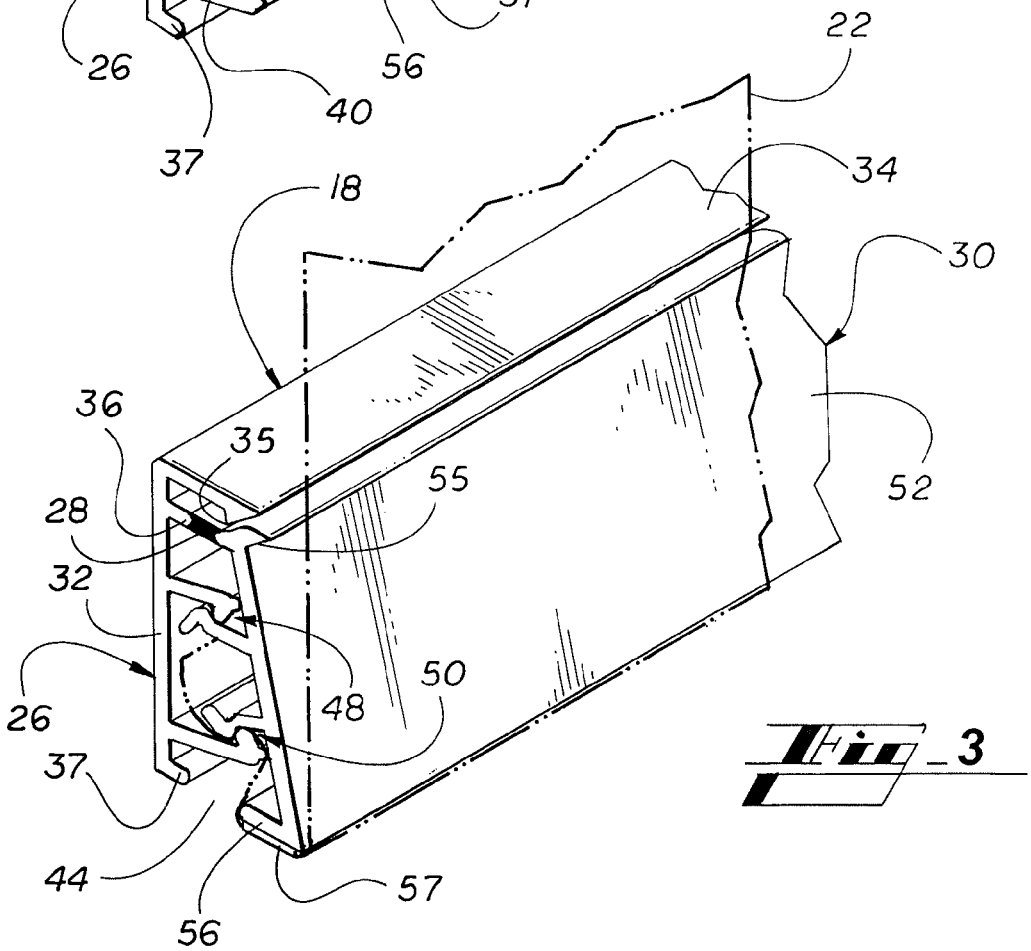
FIG. 3 is a perspective view of the track of FIG. 2 in a closed position in accordance with the first embodiment of the present invention.
Figure 4:
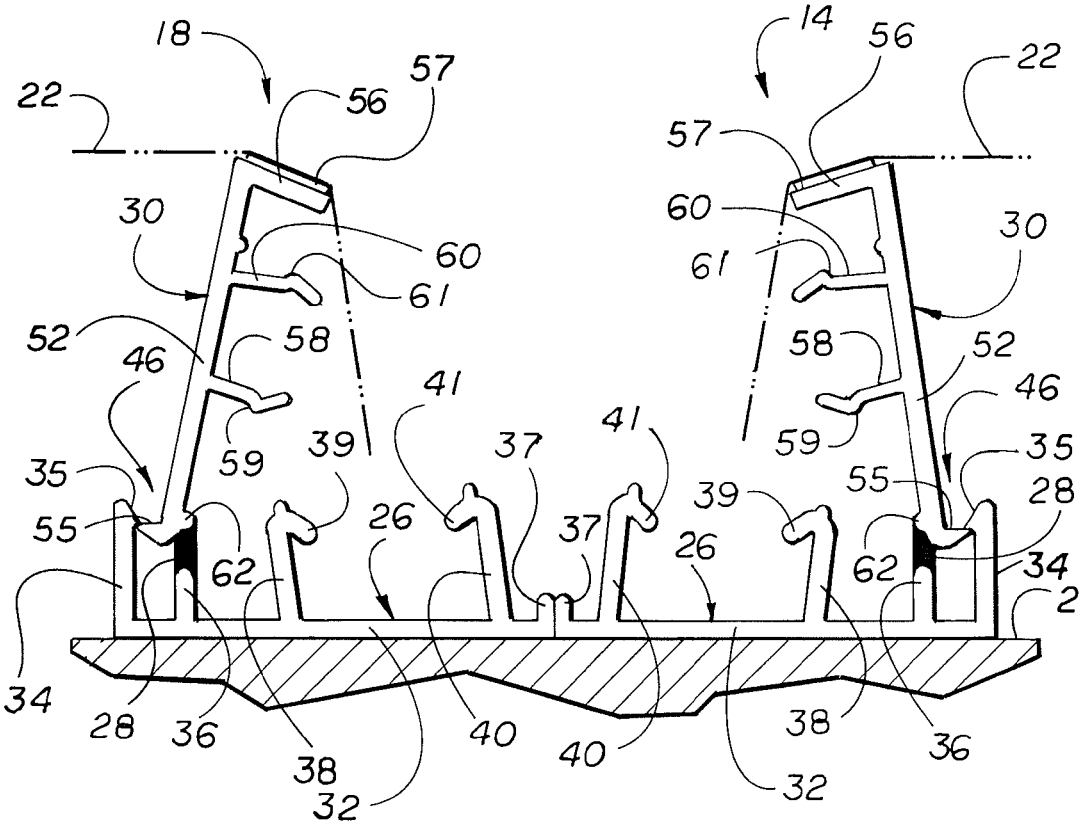
FIG. 4 is a cross-section view of the tracks of two adjacent fabric wall panels in accordance with the first embodiment of the present invention as seen along line 4-4 in FIG. 1 with the track in the open position.
Figure 5:
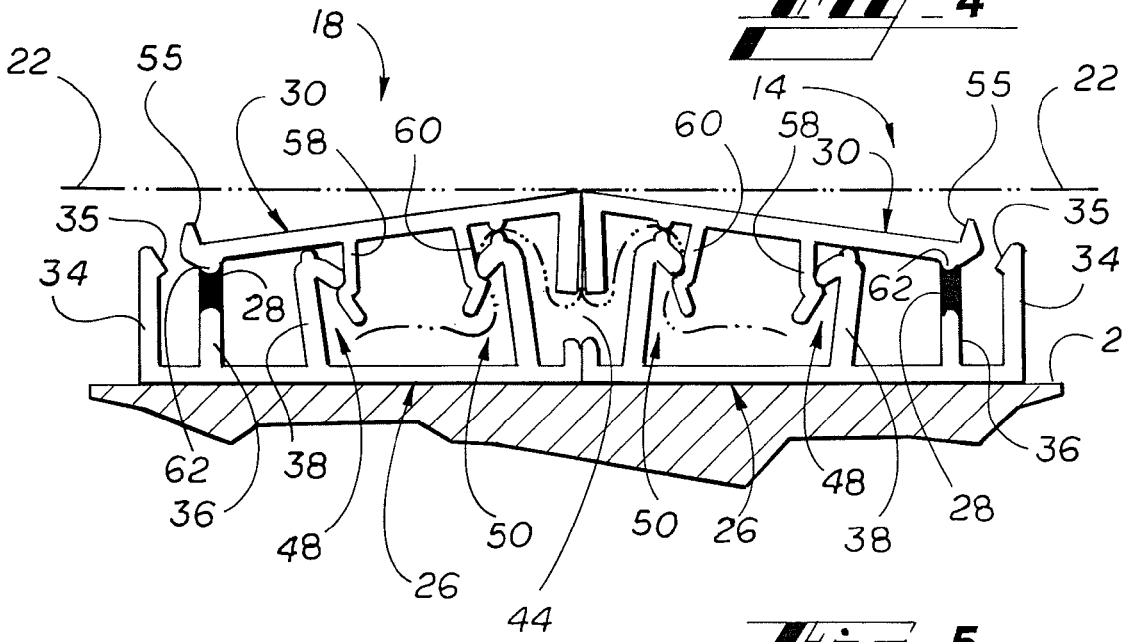
FIG. 5 is a cross-section view of the tracks of two adjacent fabric wall panels in accordance with the first embodiment of the present invention as seen along line 4-4 in FIG. 1 with the track in the closed position.

The linear frame member or track 18 is shown in perspective in FIGS. 2 and 3. Adjacent tracks 14 and 18 are shown in cross-section in FIGS. 4 and 5. Each of the tracks 14 and 18, for example, comprises a stationary jaw 26 and a movable jaw 30 connected by a flexible and stretchable hinge 28. The flexible and stretchable hinge 28 is formed of melt processable rubber identified above, and the rest of the track is formed of the high impact polyvinyl chloride identified above. FIGS. 2 and 4 show the tracks 14 and 18 with the movable jaw 30 in an open position with the movable jaw 30 pivoted away from the stationary jaw 26. FIGS. 3 and 5 show the tracks 14 and 18 with the movable jaw 30 in a closed position with the movable jaw 30 pivoted into engagement with the stationary jaw 26. In the open position, the movable jaw 30 is held open by an opening lock 46. In the closed position, the movable jaw 30 is held closed by a back closing lock 48 and a front closing lock 50. While the embodiment shown in FIGS. 2-5 shows a back closing lock 48 and a front closing lock 50, the back closing lock 48 could be eliminated leaving only the front closing lock 50.

With continuing reference to FIGS. 2-5, the stationary jaw 26 comprises a stationary flat spine 32, a stationary back return 34 with a stationary back return hook 35, and a stationary front return 37. The stationary back return hook 35 forms one half of the opening lock 46. The stationary jaw 26 also includes a stationary hinge connector 36 protruding outwardly from the stationary flat spine 32 for attachment to the flexible and stretchable hinge 28. The stationary jaw 26 further includes a stationary back lock stub 38 protruding outwardly from the stationary flat spine 32 and having a stationary back lock stub hook 39. The stationary back lock stub hook 39 forms one half of the back closing lock 48. In addition, the stationary jaw 26 has a stationary front lock stub 40 protruding outwardly from the stationary flat spine 32 and having a stationary front lock stub hook 41. The stationary front lock stub hook 41 forms one half of the front closing lock 50. As best shown in FIGS. 4 and 5, the stationary flat spine 32 of the stationary jaw 26 is attached to the back wall 2 by any suitable means including adhesive, cross nailing, screws, or other suitable fastening means.

With continuing reference to FIGS. 2-5, the movable jaw 30 comprises a movable flat spine 52, a movable back end 54 with a movable back end hook 55, and a movable front return 56. The movable back end hook 55 forms one half of the opening lock 46. The movable jaw 30 also includes a movable hinge connector 62 protruding outwardly from the movable flat spine 52 for attachment to the flexible and stretchable hinge 28. The movable jaw 30 further includes a movable back lock stub 58 protruding outwardly from the movable flat spine 52 and having a movable back lock stub hook 59. The movable back lock stub hook 59 forms one half of the back closing lock 48. In addition, the movable jaw 30 has a movable front lock stub 60 protruding outwardly from the movable flat spine 52 and having a movable front lock stub hook 61. The movable front lock stub hook 61 forms one half of the front closing lock 50. A strip of double-sided tape 57 is attached to the outside of the movable front return 56 along its length.

The stationary back return hook 35 and the movable back end hook 55 together form the opening lock 46, which, as shown in FIGS. 2 and 4, holds the movable jaw 30 in the open position. The stationary back lock stub hook 39 and the movable back lock stub hook 59 together form the back closing lock 48, which, as shown in FIGS. 3 and 5, holds the movable jaw 30 in the closed position. The stationary front lock stub hook 41 and the movable front lock stub hook 61 together form the front closing lock 50, which, as shown in FIGS. 3 and 5, also holds the movable jaw 30 in the closed position.

As previously noted, the tracks 14, 16, 18, and 20 are formed by extruding the high impact premium unplasticized polyvinylcloride and the melt processable rubber. During the elevated temperature extrusion process, the flexible and stretchable hinge 28, formed of melt processable rubber identified above, is extruded in contact with the stationary hinge connector 36 and the movable hinge connector 62, formed of the high impact premium unplasticized polyvinylcloride. As the flexible and stretchable hinge 28 and the hinge connectors 36 and 62 cool, a bond is formed thereby creating the flexible and stretchable hinge 28 between the movable jaw 30 and the stationary jaw 26. Not only is the flexible and stretchable hinge 28 flexible in terms of allowing the stationary jaw 26 and the movable jaw 30 to pivot with respect to each other, the flexible and stretchable hinge 28 also allows for stretching to enable the stationary back return hook 35 and the movable back end hook 55 to engage to lock the movable jaw 30 in the open position and disengage to unlock the movable jaw 30 in order for the movable jaw to pivot to the closed position.

In order to install the fabric panels 10 on the back wall 2, for example, the installer first creates the square frame 12 by cutting each of the tracks 14, 16, 18, and 20 to the desired length, by mitering the ends of the tracks 14, 16, 18, and 20, and by attaching the tracks 14, 16, 18, and 20 to the back wall 2. Particularly, the installer attaches the stationary flat spine 32 of each of the tracks 14, 16, 18, and 20 to the back wall 2 by nailing, screws, adhesive, or other suitable attachment means. The tracks 14, 16, 18, and 20 are oriented so that the opening 44 (FIG. 5) of each of the tracks faces outwardly from the center of the frame 12. Consequently, for adjacent fabric panels 10*a* and 10*b*, the opening of the track 14 of fabric panel 10*b* and the opening of the track 18 of fabric panel 10*a* are oriented as shown in FIGS. 4 and 5.

Once each of the tracks are attached to the back wall 2, the movable jaw 30 is locked in the open position by means of the opening lock 46. After the movable jaw 30 is locked in the open position, the covering of the double-sided tape 57 is removed, and the fabric 22 is positioned over the double-sided tape 57 of the movable front return 56 of the movable jaw 30 as shown in FIG. 4. As of the movable jaw 30 pivots about the hinge 28 to the close position shown in FIG. 5, the double-sided tape 57 grips the fabric 22 and stretches the fabric 22. Once movable jaw 30 is moved to the closed position, the back closing lock 48 and the front closing lock 50 engage the fabric 22 and simultaneously grip the fabric 22 and lock the movable jaw 30 in the closed position. As previously stated, the movable front return 56 and the stationary front return 37 are dimensioned so that the fabric access opening 44 is created to allow for thick fabric. Further, the movable front return 56 is flexible and offset from the front closing lock 50 so that the movable front return 56 can flex in response to the tension in the fabric 22 without compromising the security of the front closing lock 50.

In order to replace the fabric 22 in the fabric panel 10, the movable jaw 30 is disengaged from the stationary jaw 26 by prying the movable jaw 30 away from the stationary jaw 26 so that the front closing lock 50 and the back closing lock 48 disengage. Once the movable jaw 30 has pivoted away from the stationary jaw 26, the movable jaw 30 is locked in the open position by means of the opening lock 46. The old fabric 22 is removed and new fabric 22 is installed as previously described.

Figure 6:
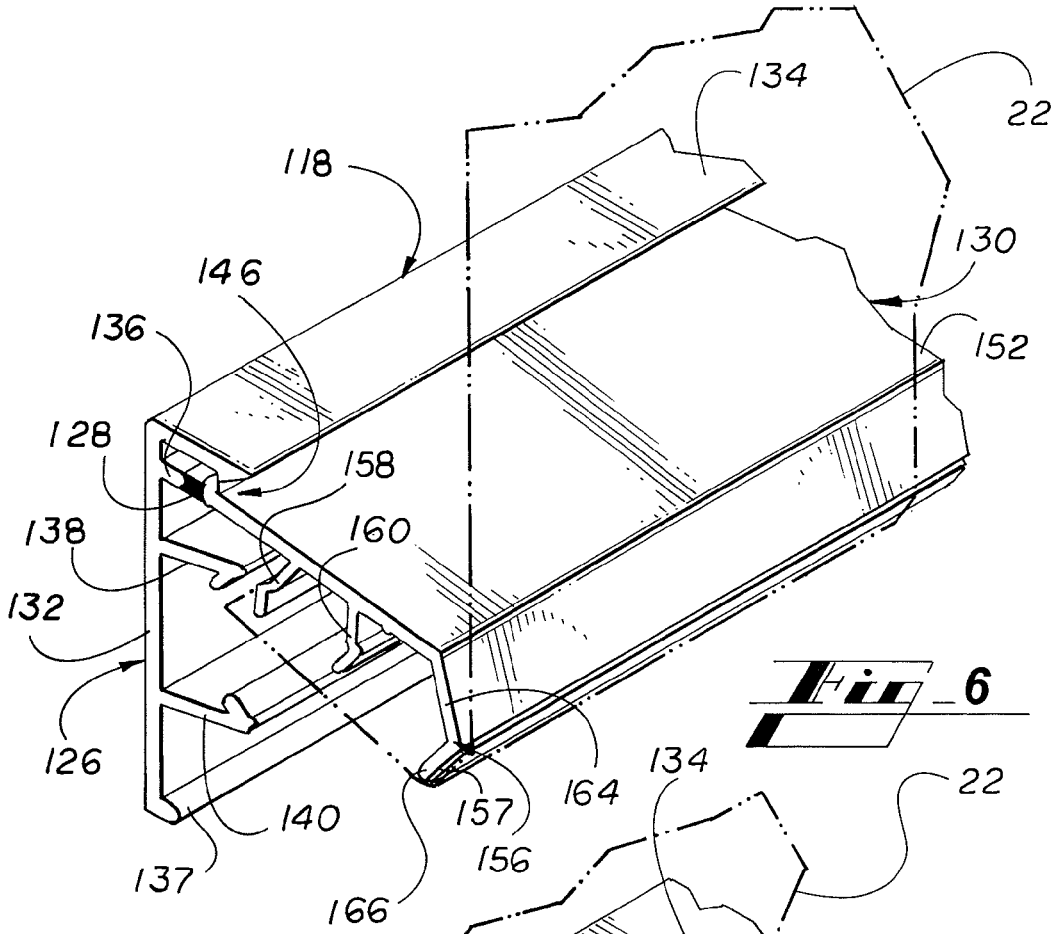
FIG. 6 is a perspective view of a frame member or track for a fabric wall panel in an open position in accordance with a second embodiment of the present invention.
Figure 7:
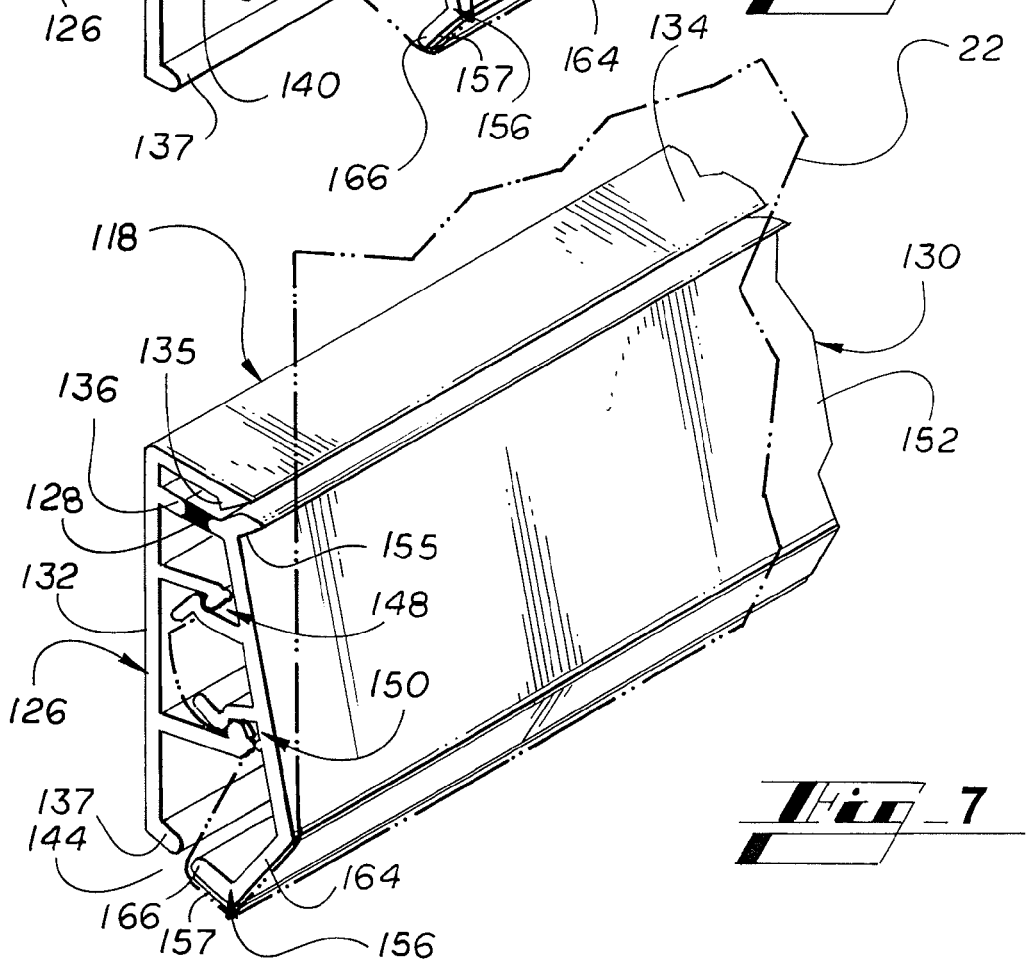
FIG. 7 is a perspective view of the track of FIG. 6 in a closed position in accordance with the second embodiment of the present invention.
Figure 8:
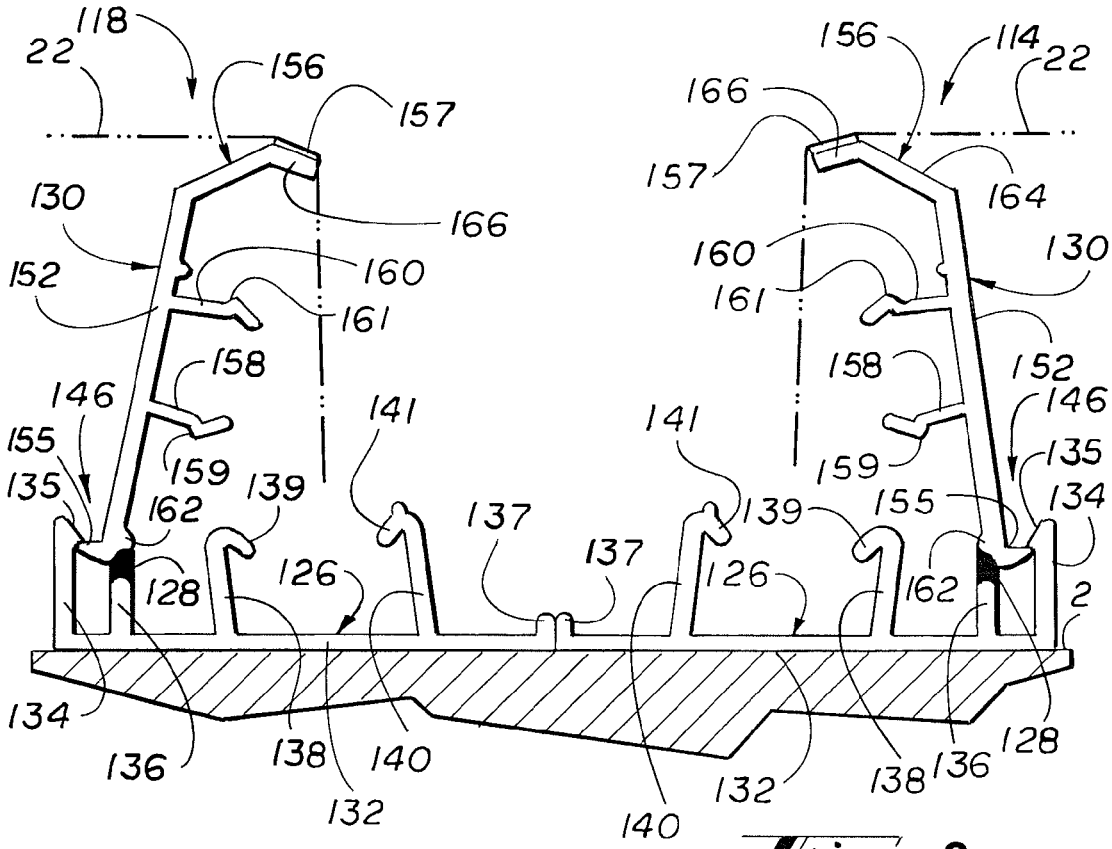
FIG. 8 is a cross-section view of the tracks of two adjacent fabric wall panels in accordance with the second embodiment of the present invention as seen along line 4-4 in FIG. 1 with the track in the open position.
Figure 9:
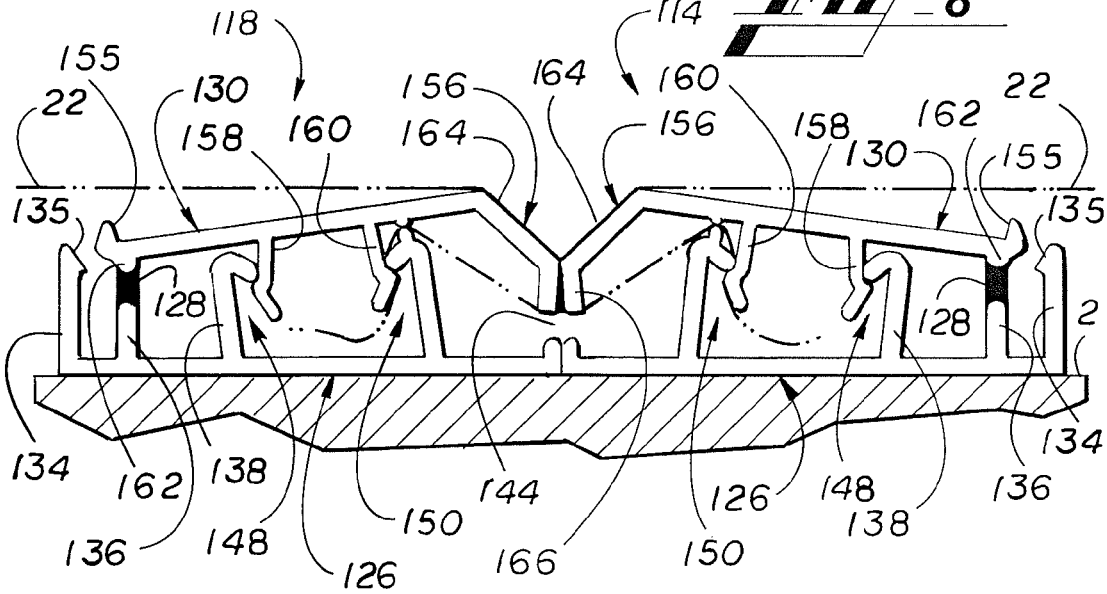
FIG. 9 is a cross-section view of the tracks of two adjacent fabric wall panels in accordance with the second embodiment of the present invention as seen along line 4-4 in FIG. 1 with the track in the closed position.

A second embodiment of the present invention is shown in FIGS. 6-9. The linear frame member or track 118 is shown in perspective FIGS. 6 and 7. Adjacent tracks 114 and 118 are shown in cross-section in FIGS. 8 and 9. Each of the tracks 114 and 118, for example, comprises a stationary jaw 126 and a movable jaw 130 connected by a flexible and stretchable hinge 128. The flexible and stretchable hinge 128 is formed of the melt processable rubber identified above, and the rest of the track is formed of the high impact polyvinyl chloride identified above. FIGS. 6 and 8 show the tracks 114 and 118 with the movable jaw 130 in an open position, and FIGS. 7 and 9 show the tracks 114 and 118 with the movable jaw 130 in a closed position. In the open position, the movable jaw 130 is held open by an opening lock 146. In the closed position, the movable jaw 130 is held closed by a back closing lock 148 and a front closing lock 150. While the embodiment shown in FIGS. 6-9 shows a back closing lock 148 and a front closing lock 150, the back closing lock 148 could be eliminated leaving only the front closing lock 150.

With continuing reference to FIGS. 6-9, the stationary jaw 126 comprises a stationary flat spine 132, a stationary back return 134 with a stationary back return hook 135, and a stationary front return 137. The stationary back return hook 135 forms one half of the opening lock 146. The stationary jaw 126 also includes a stationary hinge connector 136 protruding outwardly from the stationary flat spine 132 for attachment to the flexible and stretchable hinge 128. The stationary jaw 126 further includes a stationary back lock stub 138 protruding outwardly from the stationary flat spine 132 and having a stationary back lock stub hook 139. The stationary back lock stub hook 139 forms one half of the back closing lock 148. In addition, stationary jaw 126 has a stationary front lock stub 140 protruding outwardly from the stationary flat spine 132 and having a stationary front lock stub hook 141. The stationary front lock stub hook 141 forms one half of the front closing lock 150. As best shown in FIGS. 8 and 9, the stationary flat spine 132 of the stationary jaw 126 is attached to the back wall 2 by any suitable means including adhesive, cross nailing, screws, or other suitable fastening means.

With continuing reference to FIGS. 6-9, the movable jaw 130 comprises a movable flat spine 152, a movable back end 154 with a movable back end hook 155, and a movable front return 156 comprising a first segment 164 and a second segment 166. The movable back end hook 155 forms one half of the opening lock 146. The movable jaw 130 also includes a movable hinge connector 162 protruding outwardly from the movable flat spine 152 for attachment to the flexible and stretchable hinge 128. The movable jaw 130 further includes a movable back lock stub 158 protruding outwardly from the movable flat spine 152 and having a movable back lock stub hook 159. The movable back lock stub hook 159 forms one half of the back closing lock 148. In addition, the movable jaw 130 has a movable front lock stub 160 protruding outwardly from the movable flat spine 152 and having a movable front lock stub hook 161. The movable front lock stub hook 161 forms one half of the front closing lock 150. A strip of double-sided tape 157 is attached to the outside of the second segment 166 of movable front return 156 along its length.

The stationary back return hook 135 and the movable back end hook 155 together form the opening lock 146, which, as shown in FIGS. 6 and 8, holds the movable jaw 130 in the open position. The stationary back lock stub hook 139 and the movable back lock stub hook 159 together form the back closing lock 148, which, as shown in FIGS. 7 and 9, holds the movable jaw 130 in the closed position. The stationary front lock stub hook 141 and the movable front lock stub hook 161 together form the front closing lock 150, which, as shown in FIGS. 7 and 9, also holds the movable jaw 130 in the closed position.

As previously noted, the tracks 114, 116, 118, and 120 are formed by extruding the high impact premium unplasticized polyvinylcloride and the melt processable rubber. During the elevated temperature extrusion process, the flexible and stretchable hinge 128, formed of melt processable rubber identified above, is extruded in contact with the stationary hinge connector 136 and the movable hinge connector 162, formed of the high impact premium unplasticized polyvinylcloride. As the flexible and stretchable hinge 128 and the hinge connectors 136 and 162 cool, a bond is formed thereby creating the flexible and stretchable hinge 128 between the movable jaw 130 and the stationary jaw 126. Not only is the flexible and stretchable hinge 128 flexible in terms of allowing the stationary jaw 126 and the movable jaw 30 to pivot with respect to each other, the flexible and stretchable hinge 128 also allows for stretching to enable the stationary back return hook 135 and the movable back end hook 155 to engage to lock the movable jaw 130 in the open position and disengage to unlock the movable jaw 30 in order for the movable jaw 30 to pivot to the closed position.

As is apparent from the description above, the only difference between the first embodiment and the second embodiment is the construction of the movable front return 156 of the second embodiment. As described above, the movable front return 156 comprises a first segment 164 that attaches to the movable flat spine 152 at an obtuse angle. The second segment 166 is connected to the opposite end of the first segment 164 at an obtuse angle so that the angle between an extension of the second segment 166 and an extension of the movable flat spine 152 forms an acute angle. Consequently, the movable front return 156 still provides the flexibility and offset from the front closing lock 150 necessary to ensure the integrity of the front closing lock 150 when tension is applied to the movable front return 156 by the fabric 22.

While this invention has been described with reference to preferred embodiments thereof, it is to be understood that variations and modifications can be affected within the spirit and scope of the invention as described herein and as described in the appended claims.

We claim:

1. A fabric wall panel for a wall comprising:

a. a frame comprising a plurality of frame members for attachment to the wall to form the frame, each frame member comprising:

i. a stationary jaw for attachment to the wall and including a stationary front lock stub;

ii. a movable jaw including a movable front lock stub;

iii. a hinge for connecting the movable jaw to the stationary jaw, so that the movable jaw can pivot from an open position separated from the stationary jaw to a close position where the movable jaw engages the stationary jaw;

iv. a front closing lock, formed by the stationary front lock stub and the movable front lock stub, for securing the stationary jaw to the movable jaw when the movable jaw is in the closed position;

v. a flexible front return on the movable jaw that is offset from the front closing lock and dimensioned to define a fabric access opening between the movable jaw and the stationary jaw and wherein the stationary front lock stub is positioned between the flexible front return and the movable front lock stub in the closed position; and vi. a back closing lock positioned between the front closing lock and the hinge; and b. a fabric that is stretched over and around the flexible front return of the movable jaw of each frame member when the movable jaw is in the open position and that is secured between the stationary front lock stub and the movable front lock stub of each frame member when the movable jaw is in the closed position.

2. The fabric wall panel of claim 1, wherein the hinge is flexible and stretchable.

3. The fabric wall panel of claim 1, wherein the movable jaw and the stationary jaw have an opening lock positioned adjacent the hinge, and the opening lock engages to hold the movable jaw in the open position and disengages to allow the movable jaw to pivot to the closed position.

4. A frame member for fabric wall panel comprising:

a. a stationary jaw for attachment to the wall and including a stationary front lock stub;

b. a movable jaw including a movable front lock stub;

c. a hinge for connecting the movable jaw to the stationary jaw, so that the movable jaw can pivot from an open position separated from the stationary jaw to a close position where the movable jaw engages the stationary jaw;

d. a front closing lock, formed by the stationary front lock stub and the movable front lock stub, for securing the stationary jaw to the movable jaw when the movable jaw is in the closed position and for securing a fabric between the stationary front lock stub and the movable front lock stub;

e. a back closing lock positioned between the front closing lock and the hinge; and f. a flexible front return on the movable jaw that is offset from the front closing lock and dimensioned to define a fabric access opening between the movable jaw and the stationary jaw and wherein the stationary front lock stub is positioned between the flexible front return and the movable front lock stub in the closed position.

5. The frame member of claim 4, wherein the hinge is flexible and stretchable.

6. The frame member of claim 4, wherein the movable jaw and the stationary jaw have an opening lock positioned adjacent the hinge, and the opening lock engages to hold the movable jaw in the open position and disengages to allow the movable jaw to pivot to the closed position.

* * * * *